US008245331B1

(12) United States Patent
Chien Chen

(10) Patent No.: US 8,245,331 B1
(45) Date of Patent: Aug. 21, 2012

(54) CRIB FRAME

(76) Inventor: Ching-Ying Chien Chen, Kaohsiung (TW)

( * ) Notice: Subject to any disclaimer, the term of this patent is extended or adjusted under 35 U.S.C. 154(b) by 0 days.

(21) Appl. No.: 13/410,474

(22) Filed: Mar. 2, 2012

(51) Int. Cl.
*A47D 7/03* (2006.01)
*A47C 19/02* (2006.01)

(52) U.S. Cl. ..... 5/93.1; 5/11; 5/207

(58) Field of Classification Search ..... 5/93.1, 5/11, 200.1, 201, 207–209, 285
See application file for complete search history.

(56) References Cited

U.S. PATENT DOCUMENTS 1,336,397 A * 4/1920 Travis et al. ..... 5/208
1,694,659 A * 12/1928 Kusterle ..... 5/11
2,240,978 A * 5/1941 Bukolt ..... 5/11
2,242,307 A * 5/1941 Kroll et al. ..... 5/11
2,297,963 A * 10/1942 Kroll et al. ..... 5/11
2,328,316 A * 8/1943 Webb ..... 5/11
2,357,218 A * 8/1944 Merrett ..... 5/11
2,397,697 A * 4/1946 Shaw ..... 5/11
2,447,722 A * 8/1948 Webb ..... 5/11
2,481,965 A * 9/1949 Woller ..... 5/11
2,532,236 A * 11/1950 Klatzkin ..... 5/11
2,562,053 A * 7/1951 Mars et al. ..... 5/11
2,630,582 A * 3/1953 Bukolt ..... 5/11
2,641,775 A * 6/1953 Bukolt ..... 5/100
2,895,144 A * 7/1959 Feldman ..... 5/207
3,129,439 A * 4/1964 Michal ..... 5/93.1
3,537,115 A * 11/1970 Gordin ..... 5/207
3,636,571 A * 1/1972 Winer ..... 5/11
3,646,622 A * 3/1972 Van Riper, Jr. ..... 5/100
3,668,721 A * 6/1972 Jenkins ..... 5/109
3,883,905 A * 5/1975 Bryant ..... 5/11
3,935,603 A * 2/1976 Bryant ..... 5/11
4,744,114 A * 5/1988 Simpson et al. ..... 5/11
4,752,978 A * 6/1988 Simpson ..... 5/93.1
4,802,248 A * 2/1989 Moroney et al. ..... 5/11
4,825,482 A * 5/1989 Paris ..... 5/11
4,924,539 A * 5/1990 Benoit ..... 5/100
5,361,432 A * 11/1994 Shamie ..... 5/11
8,112,834 B1 * 2/2012 Shamie et al. ..... 5/93.1

* cited by examiner

*Primary Examiner* — Robert G Santos
(74) *Attorney, Agent, or Firm* — Muncy, Geissler, Olds & Lowe, PLLC

(57) ABSTRACT

A crib frame includes a main frame, a mattress support frame located at the bottom end of the main frame with two width sides each having two anchor holes, and two sets of symmetrical first and second connection racks. The first and second connection racks respectively include a first bracing plate and a second bracing plate, a first upright plate and a second upright plate extended respectively and horizontally from the first and second bracing plates, and a first support plate and a second support plate extended respectively and vertically from a lower end of the first and second upright plates. The first and second support plates have respectively a first elongate adjustment slot and a second elongate adjustment slot. The first and second elongate adjustment slots are coupled with two anchor holes, thereby the mattress support frame with varying specifications can be at desired locations to improve safety.

4 Claims, 6 Drawing Sheets

CRIB FRAME

FIELD OF THE INVENTION

The present invention relates to a crib frame and particularly to a crib frame that is safer and less likely to sway and adaptable to mattress support frames with varying specifications.

BACKGROUND OF THE INVENTION

Please refer to FIGS. 1, 2A and 2B, a conventional crib frame 10 includes a frame 20, a bottom frame 30 and four connection planks 40. The frame 20 has four corner pillars 21 at four corners each having a row of cavities 211 formed thereon. Each connection plank 40 has a first aperture 41 at one end corresponding to one orifice 32 on the vertical surface of a width side 31 of the bottom frame 30 and run through and fastened by a first screw 42. The connection plank 40 has a second aperture 43 at another end run through by a second screw 44 and fastened to one of the cavities 211. When a baby grows gradually to prevent the baby from crawling outside the crib the connection planks 40 can be adjusted by changing the fastened cavities 211 to lower the height of the bottom frame 30.

As shown in FIG. 2A, the aforesaid structure has a drawback, i.e. in the event that the bottom frame 30*a* is a smaller size with a narrower width on the two width sides 31*a* the two orifices 32 are shrunk inwards compared with that of the width sides 31 of the larger bottom frame 30. Hence when the connection planks 40 are fastened to the lowest cavities 211 and the bottom frame 30*a* is fastened to the first aperture 41, the bottom frame 30*a* is raised, added the height of the mattress (not shown in the drawings), the baby in the crib can easily crawl outside the frame 20 and risk in injury. Moreover, with the connection planks 40 fastened axially on the vertical surface of the two width sides 31, as shown in FIG. 2B, the first screw 42 is subject to a great shearing force; in addition, with the width sides 31 narrower than the frame 20, a gap is formed between them, and swaying of the bottom frame 30 takes place when the baby is moving in the crib (as shown by the arrows in FIG. 2A), the screws 42 and 44 are easily loosened and worn, and could result in broken and collapse of the bottom frame 30 after a period of time and cause injury of the baby.

SUMMARY OF THE INVENTION

The primary object of the present invention is to provide a crib frame to eliminate the potential risks in the conventional crib frame that the crib frame easily raises caused by different specifications and different positions of orifices, the crib frame easy sways, and screws withstand excessive shearing forces to easily result in damage.

To achieve the foregoing object, the invention provides a crib frame that includes a main frame, a mattress support frame located at the bottom end of the main frame with two width sides each having two anchor holes, and two sets of first connection racks and two sets of second connection racks that are symmetrical to each other. The main frame has four pillars at four corners each having a row of adjustment cavities formed thereon. Depending on requirements of safety height, the first and second connection racks can be fastened to the adjustment cavities at varying positions. The first and second connection racks respectively have another end fastened to the mattress support frame.

The first and second connection racks respectively include a first bracing plate and a second bracing plate, a first upright plate and a second upright plate extended respectively and horizontally from the first and second bracing plates, and a first support plate and a second support plate extended respectively and vertically from a lower end of the first and second upright plates. The first and second support plates have respectively a first elongate adjustment slot and a second elongate adjustment slot. The first and second bracing plates have respectively a first fastening hole and a second fastening hole on an upper end corresponding to and fastening to the adjustment cavities via a first fastening element. The two anchor holes of the mattress support frame are vertically coupled with the first and second elongate adjustment slots of the first and second support plates such that the first and second upright plates and the first and second support plates provide a support base for the mattress support frame without swaying. Such a structure also distributes the gravity received by the first and second bracing plates. With the two anchor holes on one width side of the mattress support frame vertically coupling with the first and second elongate adjustment slots, the mattress support frame with different specifications can be coupled with the first and second elongate adjustment slots at desired positions. The crib frame thus formed is simpler and safer.

In short, the crib frame of the invention provides many advantages, notably: studier, safer and easier to assemble and install. It also can be adjusted with growing of the baby to hold the mattress support frames with varying specifications and achieve improved safety.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
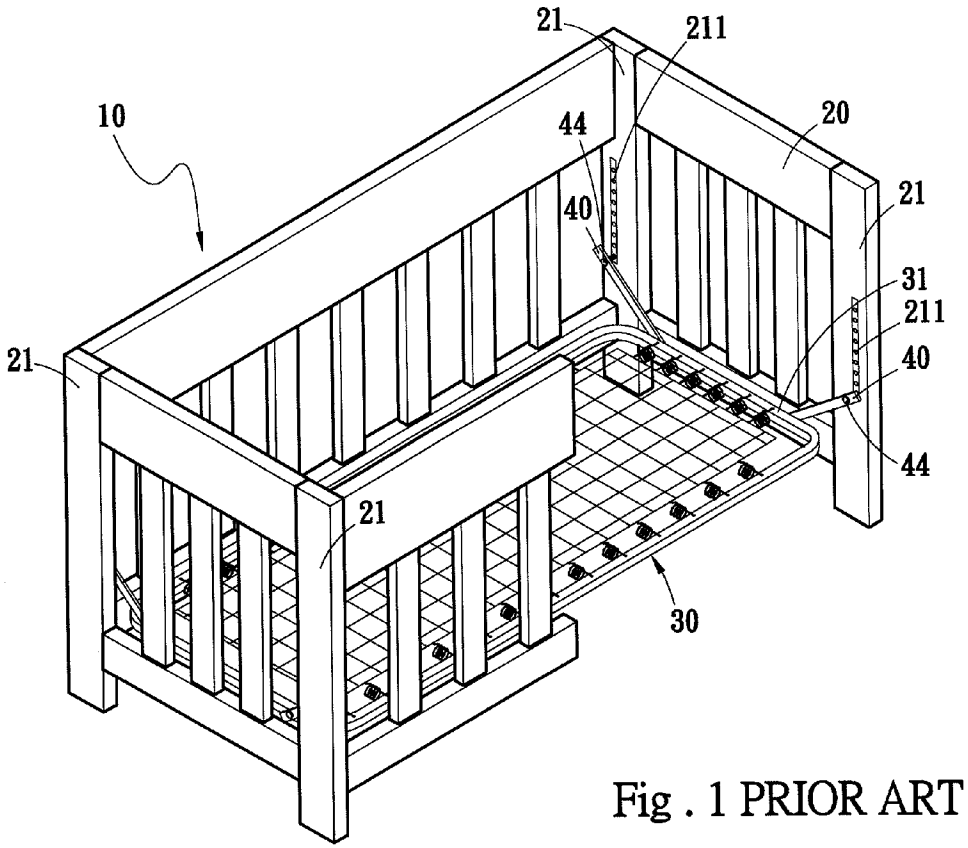
Fig . 1 PRIOR ART
FIG. 1 is a perspective view of a conventional crib frame.
Figure 2A:
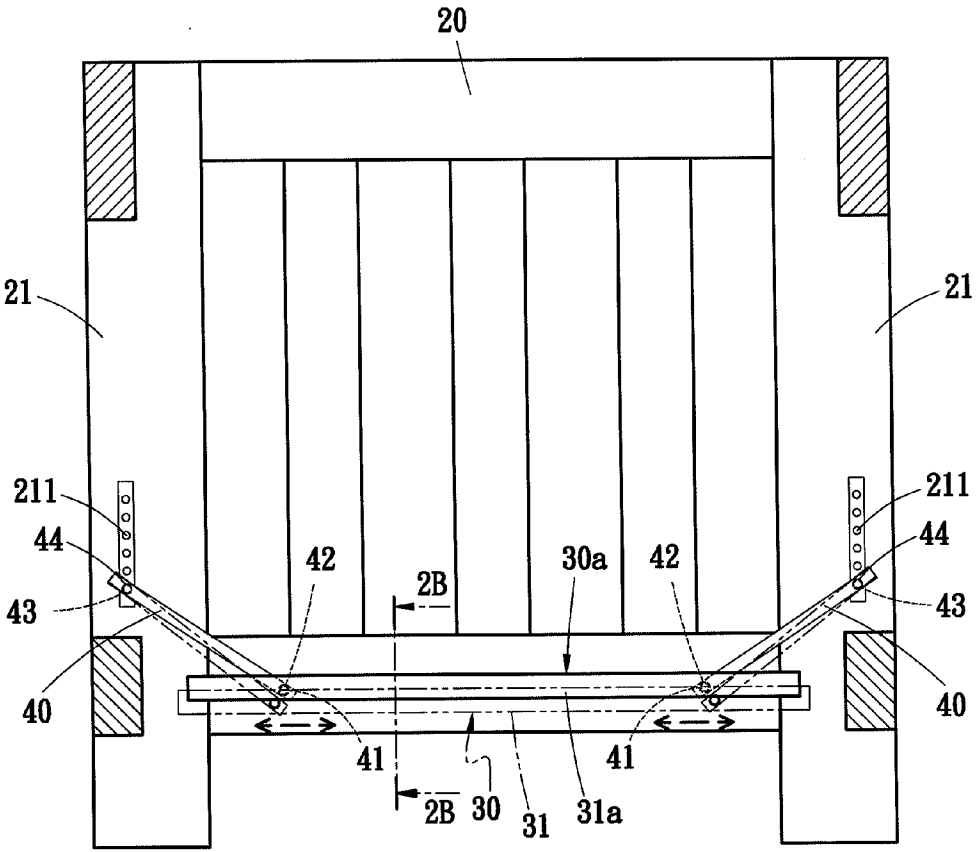
Fig. 2A PRIOR ART
FIG. 2A is a schematic side view of a conventional crib frame.
Figure 2B:
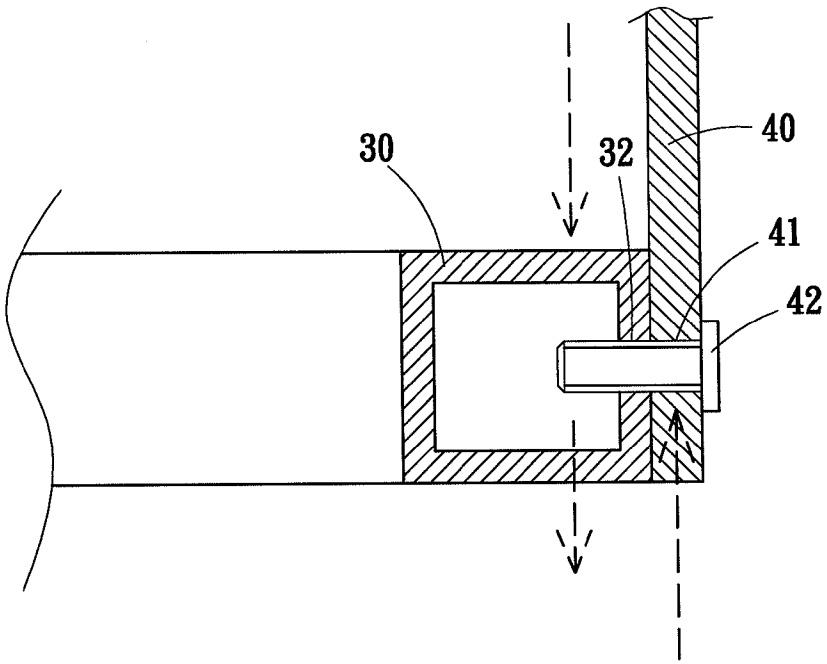
Fig. 2B PRIOR ART
FIG. 2B is a cross section taken on line 2B-2B in FIG. 2A.
Figure 3:
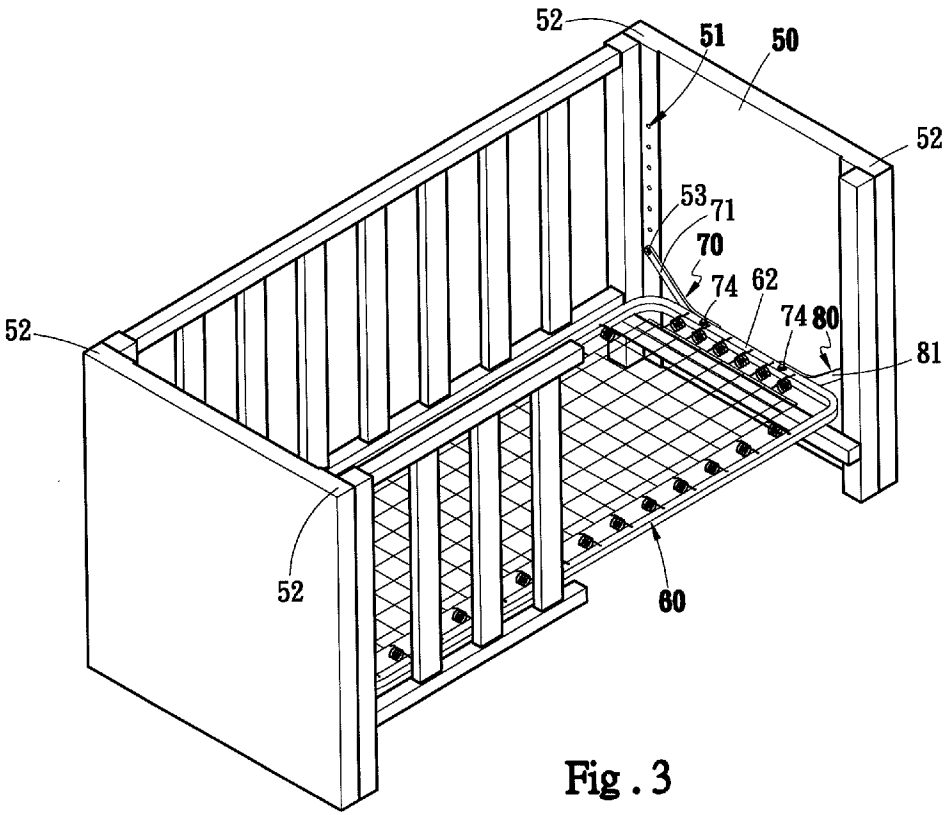
FIG. 3 is a perspective view of the crib frame of the invention.
Figure 4:
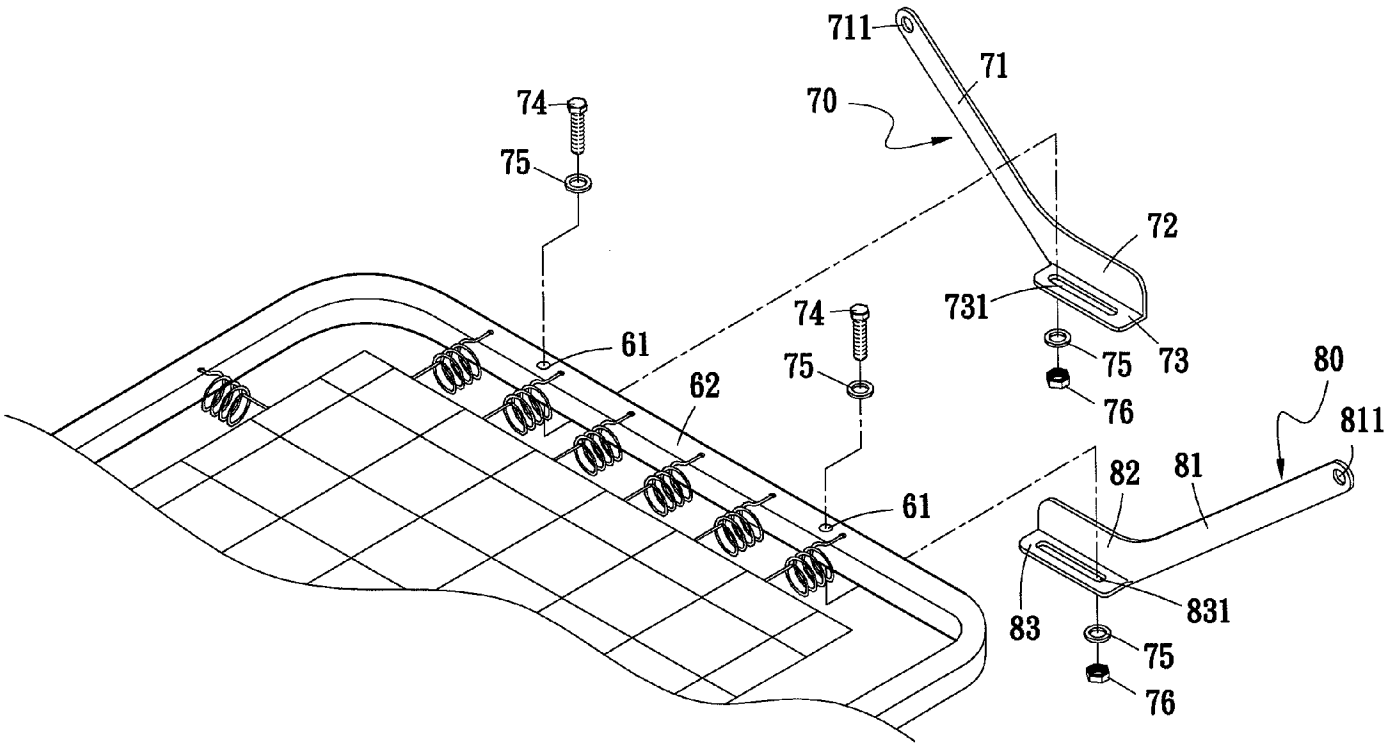
FIG. 4 is an exploded view of the first and second connection racks and mattress support frame of the invention.

Please refer to FIGS. 3 and 4, the present invention aims to provide a crib frame that includes a main frame 50, a mattress support frame 60 and two sets of first connection racks 70 and two sets of second connection racks 80 that are symmetrical to each other.

The main frame 50 has four pillars 52 at four corners each having a row of adjustment cavities 51 formed thereon to facilitate adjustment according to the height of a baby and safety requirement.

The mattress support frame 60 is located at the bottom end of the main frame 50 with two width sides 62 each having two anchor holes 61 formed thereon.

As shown in FIG. 4, the first and second connection racks 70 and 80 include respectively a first bracing plate 71 and a second bracing plate 81, a first upright plate 72 and a second upright plate 82 extended respectively from one end of the first and second bracing plates 71 and 81, and a first support plate 73 and a second support plate 83 extended respectively and vertically from the first and second upright plates 72 and 82. The first and second bracing plates 71 and 81 have respectively a first fastening hole 711 and a second fastening hole 811 on an upper end corresponding to the adjustment cavities 51. The first and second support plates 73 and 83 have respectively a first elongate adjustment slot 731 and a second elongate adjustment slot 831 corresponding to the anchor holes 61 to facilitate vertical fastening to the mattress support frame 60 with varying widths.

Figure 5:
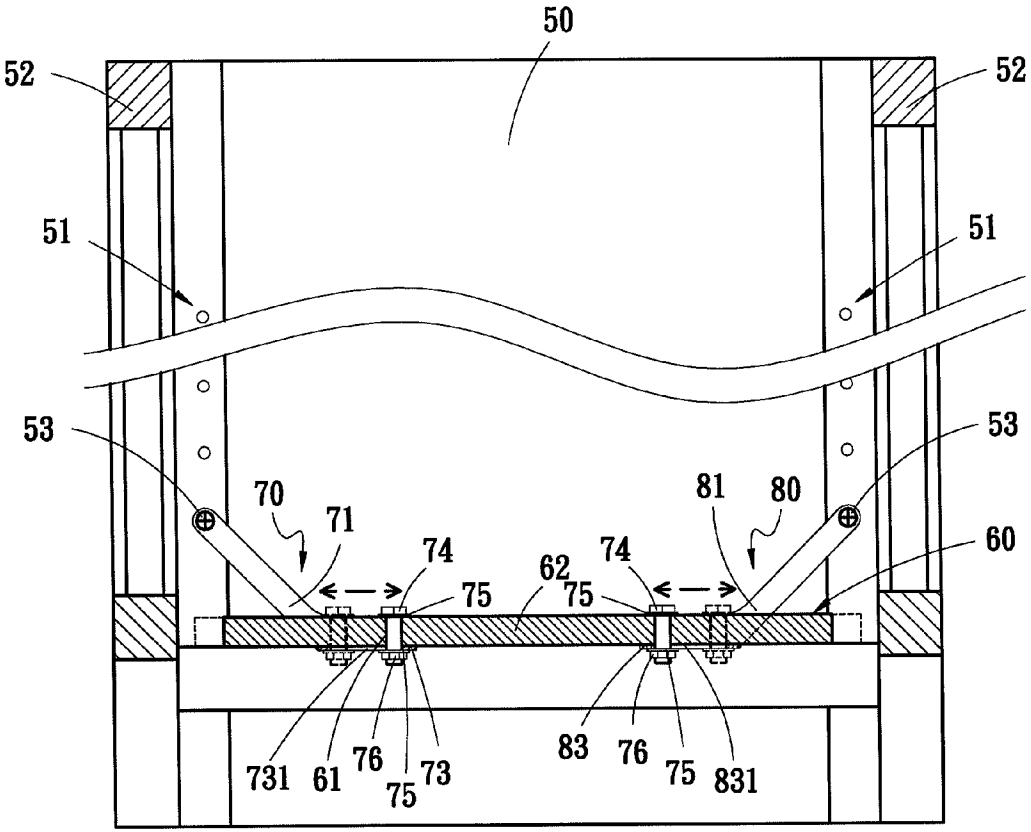
FIG. 5 is a local sectional view of the crib frame of the invention.

Referring to FIGS. 4 and 5, to adjust the elevation of the mattress support frame 60, the first and second fastening holes 711 and 811 of the first and second bracing plates 71 and 81 are respectively fastened to the adjustment cavity 51 via a first fastening element 53. Moreover, to form more secure fastening, the two anchor holes 61 on each side of the mattress support frame 60 are run through by the second fastening elements 74, and the second fastening elements 74 can be fastened to the first and second elongate adjustment slots 731 and 831 via washers 75 and nuts 76 according to the width of the mattress support frame 60. Compared with the conventional technique which fastens multiple first fastening elements 53 axially to the vertical surfaces of the two width sides 62 of the mattress support frame 60, the mattress support frame 60 easily results in sway and collapse during usage. However, in the present invention, as the first and second elongate adjustment slots 731 and 831 are fastened vertically via the second fastening elements 74, the second fastening elements 74 do not need to withstand great shearing forces as the conventional crib frame 10 does, thus more secure support is provided to the mattress support frame 60 without swaying the crib frame.

What is claimed is:

1. A crib frame, comprising:

a main frame including four pillars at four corners each pillar including a row of adjustment cavities;

two sets of first connection racks and two sets of second connection racks that are symmetrical to each other, one of two sets of first connection racks and one of two sets of second connection racks including respectively a first bracing plate and a second bracing plate, a first upright plate and a second upright plate extended respectively and horizontally from the first and second bracing plates, and a first support plate and a second support plate extended respectively and vertically from a lower end of the first and second upright plates, the first and second support plates including respectively a first elongate adjustment slot and a second elongate adjustment slot, the first and second bracing plates including respectively a first fastening hole and a second fastening hole on an upper end thereof run through respectively by a first fastening element to fasten the first and second connection racks to the adjustment cavities; and a mattress support frame which is located at a bottom end of the main frame and includes two width sides each including two anchor holes, the anchor holes and the first and second elongate adjustment slots being run through by second fastening elements to fasten the mattress support frame.

2. The crib frame of claim 1, wherein the first and second bracing plates are formed in an inclined fashion.

3. The crib frame of claim 1, wherein the first fastening element is a screw running through respectively the first and second fastening holes of the first and second bracing plates and the adjustment cavities.

4. The crib frame of claim 1, wherein the second fastening elements are screws running through the first and second anchor holes and fastening to nuts, each of the second fastening elements being coupled with washers at two sides for secure fastening.

* * * * *